US007020427B2

(12) United States Patent
Hart

(10) Patent No.: US 7,020,427 B2
(45) Date of Patent: Mar. 28, 2006

(54) CARRIER PICKOFF SYSTEM SUITABLE FOR CUSTOMER-REPLACEABLE XEROGRAPHIC PRINTER CARTRIDGES

(75) Inventor: Steven C. Hart, Webster, NY (US)

(73) Assignee: Xerox Corporation, Stamford, CT (US)

( * ) Notice: Subject to any disclaimer, the term of this patent is extended or adjusted under 35 U.S.C. 154(b) by 12 days.

(21) Appl. No.: 10/892,862

(22) Filed: Jul. 15, 2004

(65) Prior Publication Data

US 2006/0013626 A1 Jan. 19, 2006

(51) Int. Cl.
*G03G 21/00* (2006.01)

(52) U.S. Cl. ..... 399/350; 399/356

(58) Field of Classification Search ..... 399/350, 399/356, 343
See application file for complete search history.

(56) References Cited

U.S. PATENT DOCUMENTS

| | | | | |
|---|---|---|---|---|
| 4,868,607 A | | 9/1989 | Folkins et al. | 355/269 |
| 5,142,322 A | * | 8/1992 | Surti | 399/113 |
| 5,315,357 A | | 5/1994 | Kamijo et al. | 355/298 |
| 5,390,015 A | * | 2/1995 | Nagame et al. | 399/356 |
| 6,233,417 B1 | * | 5/2001 | Nakayama et al. | 399/159 |

* cited by examiner

*Primary Examiner*—David Gray
*Assistant Examiner*—Ryan D. Walsh
(74) *Attorney, Agent, or Firm*—R. Hutter

(57) ABSTRACT

A xerographic printer or copier includes a replaceable cartridge having a cleaning blade and carrier particle pickoff member associated with a rotating charge receptor. As the cartridge is being used, carrier particles removed from the photoreceptor by the cleaning blade are magnetically retained on the pickoff member, where the remain for the balance of the lifetime of the cartridge. When a useable lifetime of the cartridge is spent, the carrier particles are removed from the pickoff blade.

16 Claims, 3 Drawing Sheets

CARRIER PICKOFF SYSTEM SUITABLE FOR CUSTOMER-REPLACEABLE XEROGRAPHIC PRINTER CARTRIDGES

TECHNICAL FIELD

The present disclosure relates to xerographic printing, and in particular to the removal of carrier particles, from a two-component developer material, from the surface of a photoreceptor in a xerographic cleaning step.

BACKGROUND

In an electrophotographic printing machine, a photoconductive member, such as a photoreceptor, is charged to a substantially uniform potential to sensitize the surface thereof. The charged portion of the photoreceptor is thereafter selectively exposed. Exposure of the charged photoreceptor dissipates the charge thereon in the irradiated areas. This records an electrostatic latent image on the photoreceptor corresponding to the informational areas contained within the original document being reproduced. After the electrostatic latent image is recorded on the photoreceptor it is "developed." The development process deposits toner in the same pattern as the latent image on the photoreceptor. This developed toner is subsequently transferred to a print sheet. The sheet is then heated to permanently affix the toner image thereto in image configuration.

The electrostatically attractable developing material commonly used in developing systems comprises a pigmented resinous powder referred to here as a "toner" and a "carrier" of larger granular carrier particles formed with iron, steel, or ferrite cores coated with a material removed in the triboelectric series from the toner, so that a triboelectric charge is generated between the toner powder and the granular carrier. The toner is attracted to the electrostatic latent image from carrier bristles to produce a visible powder image on an insulating surface of the photoreceptor.

In a practical application, however, some carrier particles will adhere to the photoreceptor after an area of the photoreceptor leaves the development zone. These adhering carrier particles prevent intimate contact between the support surface (e.g., a sheet of paper) and the toner particles, and they may affect the quality of the copy produced. In addition, because such adhering carrier particles are hard, they may abrade the surface of the photoreceptor if not removed prior to reaching the cleaning zone. Consequently, it is desirable that all such carrier particles be removed from the photoreceptor with each cycle of the photoreceptor.

Many designs of xerographic printers and copiers use what will here be called "customer-replaceable units" or CRUs, or more generally "cartridges." Typically a CRU will include a photoreceptor and ancillary hardware, such as a corotron or equivalent charge device and a cleaning station. The CRU is designed to be easily removed from the larger machine and replaced with an effectively new CRU. Used CRU's can in various ways be remanufactured, such as by cleaning the CRU, replacing spent parts such as the photoreceptor, and refilling the CRU with a new supply of marking material. The present disclosure relates to a carrier particle pickoff device suitable for inclusion in a CRU.

PRIOR ART

U.S. Pat. No. 4,868,607 discloses a particle pickoff device in which a particle catch is disposed in close proximity to a photoreceptor belt, to draw off carrier particles. The drawn carrier particles are accumulated in a container.

U.S. Pat. No. 5,315,357 discloses an apparatus for removing single component magnetic toner, as opposed to carrier, from a photoreceptor in a xerographic printer.

The Xerox® 1090® copier includes a pickoff device which will be described below with reference to FIG. 4.

SUMMARY

According to one aspect, there is provided a cartridge for operating within a xerographic printing apparatus, comprising a blade for engaging a rotatable charge receptor, and a pickoff member, having magnetic properties associated therewith, disposed near the blade. The pickoff member magnetically retains carrier particles thereon for a lifetime of the cartridge.

According to another aspect, there is provided a method of operating at least one xerographic printing apparatus. A cartridge is removed from a xerographic printing apparatus, the cartridge including a blade for engaging a rotatable charge receptor and a pickoff member disposed near the blade, the pickoff member magnetically retaining carrier particles thereon. Retained carrier particles are removed from the pickoff member, using a wiper which is not part of the cartridge.

DETAILED DESCRIPTION

Figure 1:
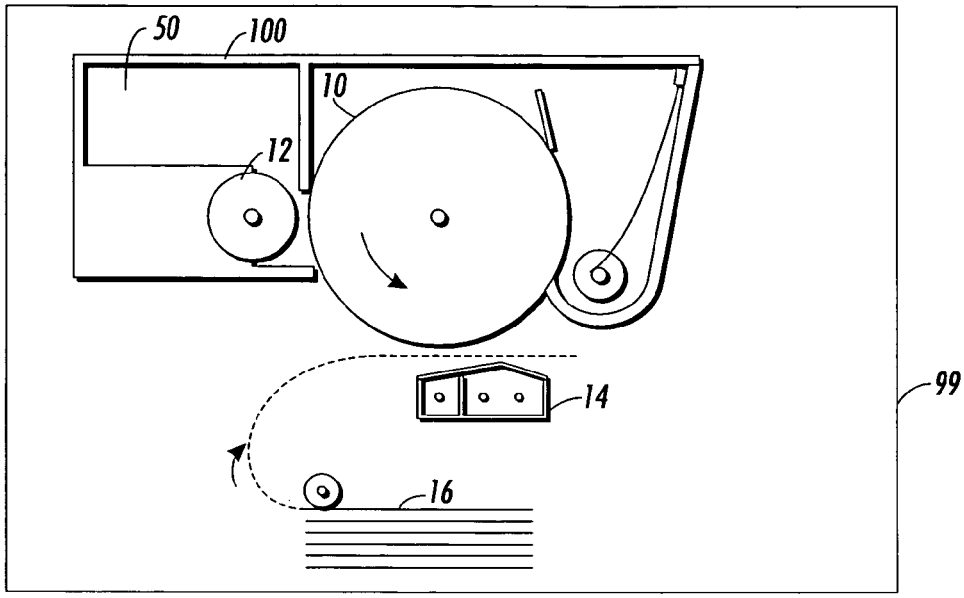
FIG. 1 is a simplified elevational view showing elements of an electrostatographic or xerographic printing apparatus.

FIG. 1 is a simplified elevational view showing relevant elements of an electrostatographic or xerographic printing apparatus, such as a printer, copier, or multifunction device generally indicated as 99. Certain elements of the apparatus are disposed within a CRU, or cartridge, generally shown as 100. As will be described in detail below, those parts of the overall machine 99 which require replacement or periodic service are typically placed within CRU 100, while longer-lasting parts are elsewhere in the machine.

As is well known, an electrostatic latent image is created, by means not shown, on a surface of a rotatable charge receptor or photoreceptor 10. The latent image is developed by applying thereto a supply of toner particles, such as with developer roll 12, which may be of any of various designs, such as including a magnetic brush roll or donor roll, as is familiar in the art. The toner particles adhere to the appropriately-charged areas of the latent image. The surface of photoreceptor 10 then moves, as shown by the arrow, to a transfer zone created by a transfer-detack assembly generally indicated as 14. Simultaneously, a print sheet on which the desired image is to be printed is drawn from supply stack 16 and conveyed to the transfer zone 14 as well. At the transfer zone 14, the print sheet is brought into contact or at least proximity with a surface of photoreceptor 10, which at this point is carrying toner particles thereon. A corotron or other charge source at transfer zone 14 causes the toner on photoreceptor 10 to be electrically transferred to the print sheet. The print sheet is then sent to subsequent stations, as is familiar in the art, such as a fuser and finishing devices (not shown).

Figure 2:
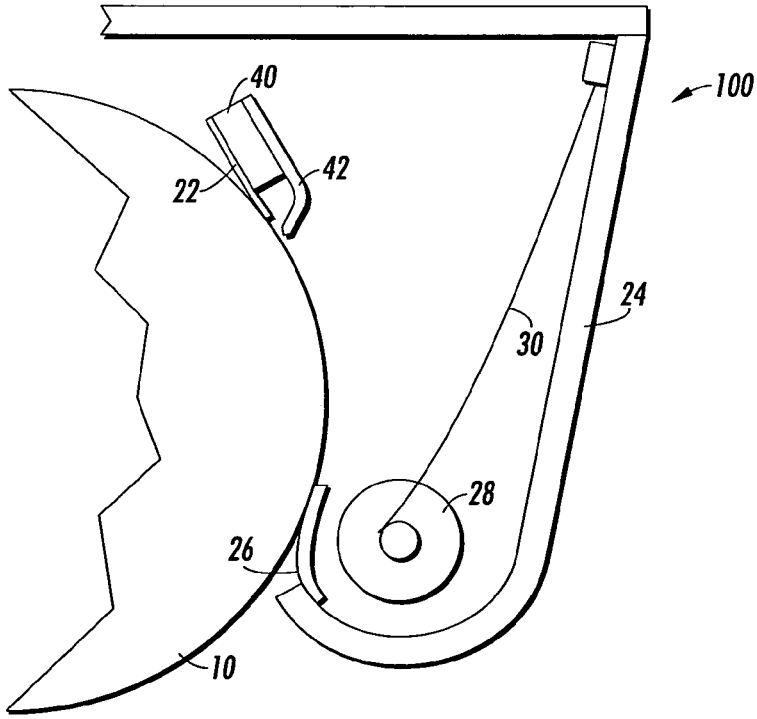
FIG. 2 is an elevational view of a cleaning station which is part of a CRU or cartridge.

Following transfer of most of the toner particles to the print sheet in the transfer zone, any residual toner particles remaining on the surface of photoreceptor 10 are removed at a cleaning station. FIG. 2 is an elevational view showing a detail of a cleaning station, which in the embodiment is part of CRU 100. As can be seen in the Figure, a cleaning blade 22 which is pressed against the surface of photoreceptor 10 scrapes the residual toner off the surface. The toner which is thus removed falls downward into a hopper 24 for accumulating the toner. A flexible flap seal 26, extending the length of the photoreceptor 10, prevents loose toner from escaping the hopper. An auger 28, with an anti-bridging device 30, is used to remove waste toner (as opposed to carrier particles) from the hopper 24.

Further as shown in FIG. 2, there is associated with cleaning blade 22 a permanent magnet 40 and a pickoff blade 42. The magnet 40 and blade 42 extend substantially the length of the cleaning blade 22 (going into the page, in the view of FIG. 2). The tip of pickoff blade 42 is disposed between 0.5 mm and 2.0 mm from the photoreceptor 10. The pickoff blade 42 should exhibit some ferro-magnetic properties, so that magnetic flux passes effectively therethrough. The interaction of the magnet 40 and pickoff blade 42 results in a significant magnetic flux through the tip of the pickoff blade 42. The magnetic flux emanating from the pickoff blade 42 attracts carrier particles, before or as they are stopped by cleaning blade 22 on the moving surface of photoreceptor 10. By removing carrier particles from the photoreceptor surface in the cleaning blade area, the pickoff blade 42 prevents scratching of the surface of photoreceptor 10 by stray carrier particles. The cleaning blade 22, of course, also removes residual toner particles from the photoreceptor 10, but that action is largely irrelevant to the behavior of the carrier particles.

As mentioned above, certain hardware elements of the overall machine 99 can be isolated into a CRU (customer-replaceable unit), or more generally "cartridge," 100, which is readily removable (and thus replaceable) relative to the whole printer. Typically the CRU 100 includes parts of the printer hardware that wear out, become dirty, or are consumed as the machine is used. In the illustrated embodiment, such parts include the photoreceptor 10, as well as various seals and bushings (not shown). Depending on an overall machine design, the CRU 100 can include a supply of marking material in a container 50, as shown in FIG. 1; in other designs the marking material supply is in a second CRU which is separate from a CRU holding the photoreceptor 10. In any case, a typical "lifetime" of a CRU is in the tens of thousands of prints output by the machine 99; as used herein, the lifetime of a CRU or cartridge is defined as an amount (which can be expressed, for instance, as time, prints made, or consumable material used) of satisfactory use of the cartridge before the cartridge needs to be replaced with a new or otherwise remanufactured or refurbished cartridge. When a cartridge is remanufactured or refurbished, it becomes for practical purposes "new" and gets a new lifetime. The lifetime of a cartridge is contrasted with the lifetime of the overall machine 99, which is intended to be many multiples that of the cartridge.

Returning to FIG. 2, as carrier particles are attracted toward the pickoff blade 42, the carrier particles remain on the pickoff blade for the remaining lifetime of the CRU 100. In practical terms, the particles remain on the pickoff blade 42 when the whole CRU 100 is removed from machine 99. Only after the CRU 100 is removed from machine 99, thus ending the particular lifetime of the CRU 100, and a refurbishing process is carried out on the CRU 100 are the particles removed from the pickoff blade 42. Of course, at the end of a lifetime the whole CRU 100 may simply be discarded, and the removal of carrier particles therefrom rendered unnecessary.

Figure 3:
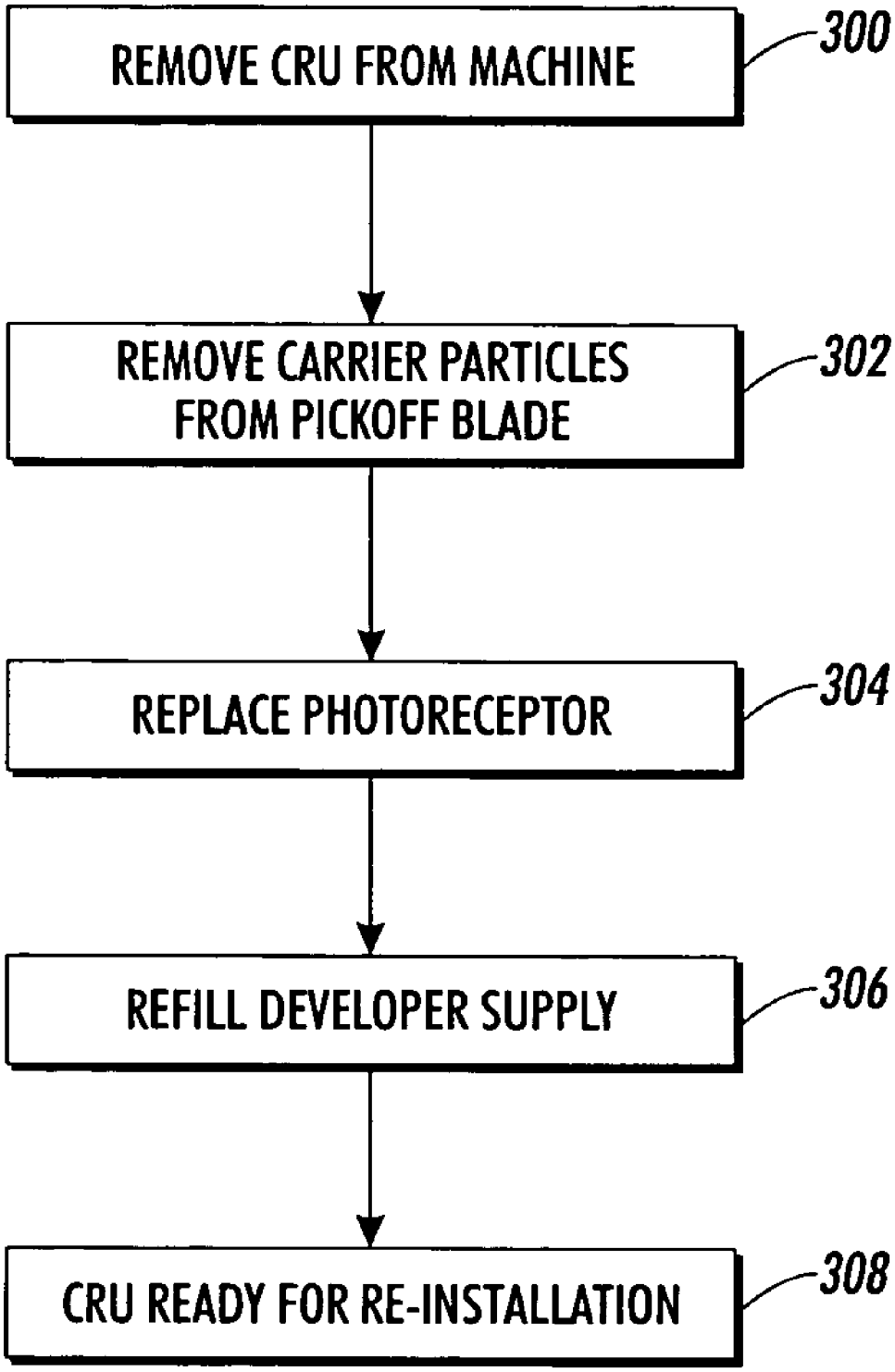
FIG. 3 is a simple flow-chart showing some steps in a CRU remanufacturing process.

FIG. 3 is a simple flow-chart showing some steps in a CRU remanufacturing process. At step 300 a CRU 100, deemed to be at the end of its lifetime by one or more of various criteria such as time, prints made, detection of faults, etc., is removed from a machine 99. At step 302 the removed CRU 100 is opened and generally cleaned, the cleaning including removing carrier particles which are magnetically attached to pickoff blade 42. The removal of carrier particles from pickoff blade 42 can be carried out by generally-known means, such as the use of brushes, blades, and/or vacuum devices (generically called a "wiper"), and can be part of a general cleaning operation on the whole of CRU 100. The brushes, blades, and/or vacuum devices for removing the carrier particles from pickoff blade 42 are, in this embodiment, not part of the CRU 100 itself. Other common steps used in the remanufacturing of cartridges include replacement of photoreceptor 10 (step 304), and refilling of the developer supply 50 (step 306). Once the CRU 100 is re-assembled and tested for proper operation, the CRU 100 is ready for re-installation in the same or another machine 99 (step 308), and a new lifetime of the CRU is deemed to begin.

Although in the illustrated embodiment the carrier particles are retained on a pickoff blade and is disposed a predetermined distance from the cleaning blade and from the photoreceptor, in other embodiments the pickoff blade or member could, for instance, be directly in contact with the cleaning blade. Alternately, the pickoff member could be mounted from an inner wall of the CRU.

Figure 4:
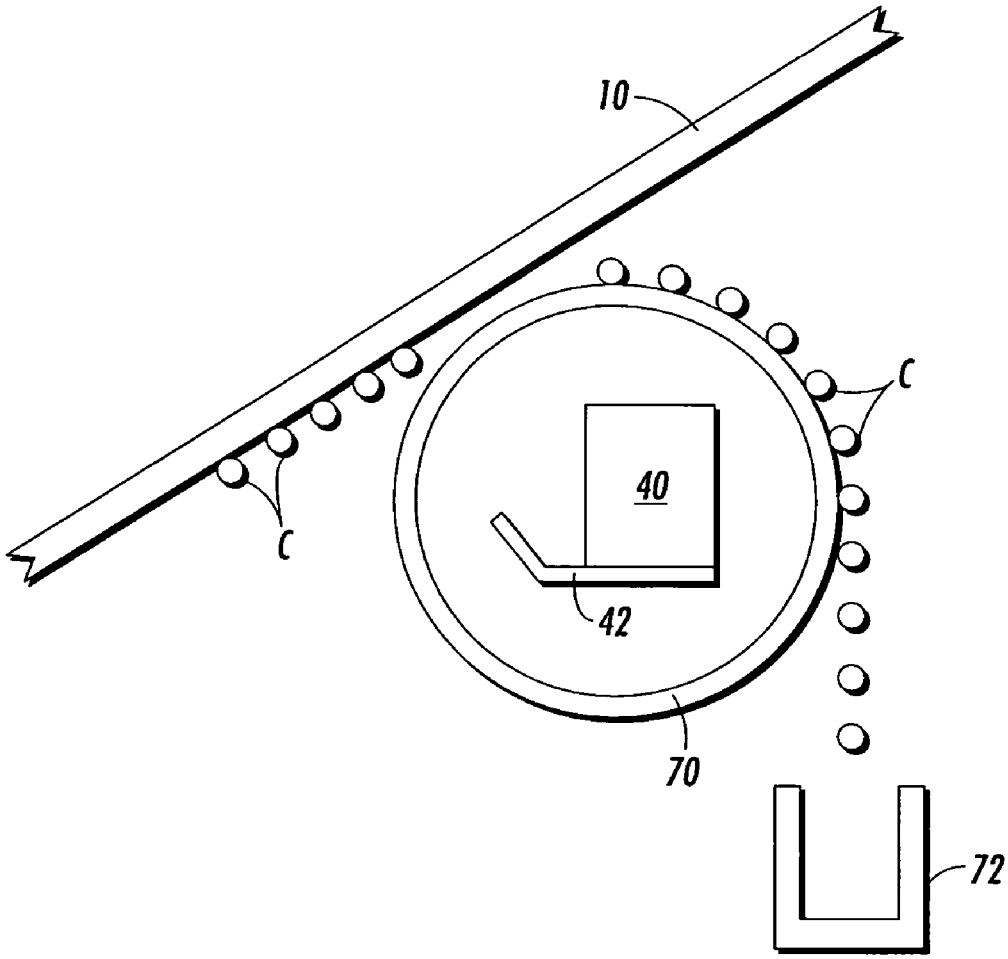
FIG. 4 PRIOR ART
FIG. 4 is a simplified elevational view of a pickoff device used in the prior art.

FIG. 4 is a simplified elevational view of a pickoff device used in the prior art, in this case the Xerox® 1090® series of copiers and printers. In FIG. 4, like reference elements relate to corresponding structures in the above-described Figures. There is present a permanent magnet 40 and a pickoff blade 42, but the assembly thereof is surrounded by a rotatable sleeve 70, a portion of which is disposed near the portion of photoreceptor 10 desired to have carrier particles removed therefrom. Thus, carrier particles, indicated as C, drawn off of photoreceptor 10 do not contact pickoff blade 42 but rather the sleeve 70. As sleeve 70 rotates, the carrier particles remain thereon, as shown, until the magnet 40 ceases to have sufficient influence to hold the carrier particles on the sleeve 70, as is evident on the right-hand side of the sleeve 70 in the Figure. The particles which thus fall off of sleeve 70 are then directed (either directly, or indirectly, such as through augers and pipes, not shown) to a separate collection bottle 72, which, in this particular embodiment, is not part of a CRU including photoreceptor 10 or pickoff blade 42.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A cartridge for operating within a xerographic printing apparatus, comprising:

a blade for engaging a rotatable charge receptor;

a pickoff member, having magnetic properties associated therewith, disposed near the photoreceptor, the pickoff member magnetically retaining carrier particles thereon for a lifetime of the cartridge.

2. The cartridge of claim 1, further comprising a rotatable charge receptor.

3. The cartridge of claim 1, further comprising a supply of marking material, the supply including carrier articles.

4. The cartridge of claim 1, the cartridge not including a member for removing a carrier particle from the pickoff member.

5. The cartridge of claim 1, the pickoff member being spaced between 0.5 mm and 2.0 mm from the charge receptor.

6. The cartridge of claim 1, the pickoff member including a permanent magnet.

7. The cartridge of claim 1, the pickoff member including a blade with ferro-magnetic properties.

8. A method of operating at least one xerographic printing apparatus, comprising:

removing from a xerographic printing apparatus a cartridge, the cartridge including a blade for engaging a rotatable charge receptor and a pickoff member disposed near the blade and photoreceptor, the pickoff member magnetically retaining carrier particles thereon; and removing retained carrier particles from the pickoff member, using a wiper which is not part of the cartridge.

9. The method of claim 8, further comprising installing the cartridge in a xerographic printing apparatus.

10. The method of claim 8, the cartridge further comprising a rotatable charge receptor.

11. The method of claim 8, further comprising replacing the rotatable charge receptor.

12. The method of claim 8, further comprising providing to the cartridge a supply of marking material.

13. The method of claim 8, the pickoff member of the cartridge being disposed along the blade.

14. The method of claim 8, the pickoff member of the cartridge being spaced between 0.5 mm and 2.0 mm from the charge receptor.

15. The method of claim 8, the pickoff member including a permanent magnet.

16. The method of claim 8, the pickoff member including a blade with ferro-magnetic properties.

* * * * *